US008448711B2

(12) United States Patent
Miller

(10) Patent No.: US 8,448,711 B2
(45) Date of Patent: May 28, 2013

(54) PRESSURE BALANCED DRILLING SYSTEM AND METHOD USING THE SAME

(76) Inventor: Charles J. Miller, Bolton, CT (US)

( * ) Notice: Subject to any disclaimer, the term of this patent is extended or adjusted under 35 U.S.C. 154(b) by 329 days.

(21) Appl. No.: 12/888,482

(22) Filed: Sep. 23, 2010

(65) Prior Publication Data

US 2012/0073826 A1 Mar. 29, 2012

(51) Int. Cl.
*E21B 34/08* (2006.01)

(52) U.S. Cl.
CPC ..... *E21B 34/08* (2013.01)
USPC ..... 166/373; 166/361; 166/179

(58) Field of Classification Search
USPC ..... 175/25, 318; 166/373, 316, 179
See application file for complete search history.

(56) References Cited

U.S. PATENT DOCUMENTS

| | | | | |
|---|---|---|---|---|
| 2,609,836 | A | 9/1952 | Knox | |
| 3,667,721 | A | 6/1972 | Vujasinovic | |
| 3,870,098 | A | 3/1975 | Houston | |
| 3,889,959 | A * | 6/1975 | Persson | 277/324 |
| 4,444,401 | A | 4/1984 | Roche et al. | |
| 5,906,220 | A | 5/1999 | Thompson | |
| 6,513,594 | B1 | 2/2003 | McCalvin et al. | |
| 6,527,062 | B2 * | 3/2003 | Elkins et al. | 175/25 |
| 6,554,247 | B2 | 4/2003 | Berckenhoff et al. | |
| 6,609,533 | B2 | 8/2003 | Sundararajan | |
| 6,712,587 | B2 | 3/2004 | Gerhardt et al. | |
| 7,021,385 | B2 | 4/2006 | Ohmer et al. | |
| 7,367,411 | B2 | 5/2008 | Leuchtenberg | |
| 7,407,019 | B2 * | 8/2008 | Kinder et al. | 175/38 |
| 2003/0085036 | A1 | 5/2003 | Curtis et al. | |
| 2003/0168258 | A1 | 9/2003 | Koederitz | |
| 2004/0178003 | A1 | 9/2004 | Riet | |
| 2008/0035374 | A1 * | 2/2008 | Reitsma | 175/25 |
| 2008/0060846 | A1 | 3/2008 | Belcher et al. | |

OTHER PUBLICATIONS

International Search Report; International Application No. PCT/US2011/052688; International Filing Date: Sep. 22, 2011; Date of Mailing: Apr. 13, 2012; 3 pages.

Written Opinion of the International Searching Authority; International Application No. PCT/US2011/052688; International Filing Date: Sep. 22, 2011; Date of Mailing: Apr. 13, 2012; 3 pages.

* cited by examiner

*Primary Examiner* — William P Neuder
(74) *Attorney, Agent, or Firm* — Cantor Colburn LLP

(57) ABSTRACT

A well drilling system including: an annular valve; a well casing in fluid communication with the annular valve; a first check valve in fluid communication with the annular valve; a hydraulic cylinder including a first chamber having an inlet and an outlet, wherein the inlet of the first chamber is in fluid communication with an outlet of the first check valve; and a transfer unit including an inlet and an outlet, wherein the inlet of the transfer unit is in fluid communication with the outlet of the first chamber, the outlet of the transfer unit is in fluid communication with an inlet of a second check valve, and an outlet of the second check valve is in fluid communication with the annular valve.

26 Claims, 9 Drawing Sheets

PRESSURE BALANCED DRILLING SYSTEM AND METHOD USING THE SAME

BACKGROUND OF THE INVENTION

1. Field of the Invention

The present disclosure relates to a pressure balanced drilling system and method of controlling a pressure kick using the pressure balanced drilling system.

2. Description of the Related Art

The exploration and production of hydrocarbons from subsurface formations ultimately requires a method to reach and extract the hydrocarbons from the formation. This may be achieved by drilling a well with a drilling rig. In its simplest form, the drilling rig supports a rotatable drill string, which includes a drill bit mounted at the end of the rotatable drill string. The drill bit drills a well bore which is lined with a well casing. A pumping system is used to circulate a drilling fluid down the center of the drill string. The drilling fluid then exits the drill string through the drill bit and flows back to the surface through an annular space between the drill string and the well casing. The drilling fluid has multiple functions, including providing pressure in the well bore to prevent the influx of a fluid from the formation, to provide support to the borehole wall, to transport cuttings produced by the drill bit to the surface, to provide hydraulic power to tools fixed in the drill string, and to cool the drill bit.

A blowout preventer ("BOP") is generally used to seal a well bore. For example, drilling an oil or gas exploration well involves penetrating a variety of subsurface geologic structures, or "layers." Each layer generally includes a specific geologic composition such as, for example, shale, sandstone, or limestone. Each layer may contain a trapped fluid at a different formation pressure, and the formation pressures generally increase with increasing depth. The pressure in the well bore may be selected to at least balance the formation pressure by, for example, increasing a density of drilling mud in the well bore or increasing a pump pressure at the surface of the well.

There are occasions during drilling operations when the well bore may penetrate a layer having a formation pressure substantially higher than the pressure maintained in the well bore. When this occurs, the well is said to have "taken a kick," which is a spontaneous influx of a fluid, which may include a liquid, a gas, or a combination thereof, from the formation into the well bore. The pressure increase associated with the kick is generally produced by an influx of the fluid from the formation into the well bore. The relatively high pressure kick tends to propagate from a point of entry in the well bore up-hole (e.g., from a high pressure region to a low pressure region). In particular, because the drilling fluid is commonly circulated down the hollow drill string and up through the annular volume surrounding the drill string, gases, which may be contained in the drilling fluid, expand as they are moved towards lower pressure regions nearer the surface. The gas expansion may cause the kick to accelerate uncontrollably. Also, if the kick is allowed to reach the surface, drilling fluid, well tools, and other drilling structures may be blown out of the well-bore, resulting in a "blowout." A blowout often results in catastrophic destruction of the drilling equipment, including, for example, the drilling rig, and can result in substantial injury or the death of rig personnel.

In the event of a kick, the blowout preventer may be closed to prevent the release of fluid from the well and to stop further influx of fluid from the formation into the well. However, despite use of commercially available BOPs, and other devices, blowouts still occur. Further, recent blowouts have demonstrated that commercially available BOPs, in particular those used in offshore wells, either close the well too slowly to be effective, or are insufficiently reliable. Also, current methods of controlling and managing kicks result in undesirable down-time, increasing the cost of drilling a well. Therefore there remains a need for an improved well drilling system which provides improved well pressure control and provides a more reliable method of managing kicks.

BRIEF SUMMARY OF THE INVENTION

Disclosed herein is a well drilling system including: an annular valve; a well casing in fluid communication with the annular valve; a first check valve in fluid communication with the annular valve; a hydraulic cylinder including a first chamber having an inlet and an outlet, wherein the inlet of the first chamber is in fluid communication with an outlet of the first check valve; and a transfer unit including an inlet and an outlet, wherein the inlet of the transfer unit is in fluid communication with the outlet of the first chamber, the outlet of the transfer unit is in fluid communication with an inlet of a second check valve, and an outlet of the second check valve is in fluid communication with the annular valve.

Also disclosed is a method of controlling a pressure kick, the method including: directing a first fluid through a first check valve to a first chamber of a hydraulic cylinder; directing a second fluid from the first chamber of the hydraulic cylinder to a chamber of a transfer unit; actuating a piston of the transfer unit with the second fluid; directing a third fluid with the piston of the transfer unit through a second check valve; engaging an annular valve with at least one of the first fluid or the third fluid; and directing the third fluid into a well bore to control the pressure kick.

Also disclosed is a well drilling system including: an annular valve including a reaction chamber; an annular packer disposed in the reaction chamber; a well casing in fluid communication with the annular valve; a first check valve in fluid communication with the annular valve; a hydraulic cylinder including a first chamber having an inlet and an outlet, wherein the inlet of the first chamber is in fluid communication with an outlet of the first check valve, a first piston disposed in the first chamber, and a second piston, which is coupled to the first piston and is disposed in a second chamber of the hydraulic cylinder, and which directs a fluid which energizes a blow-out-preventer, a generator, a valve, a sensor, or a combination including at least one of the foregoing, wherein a cross-sectional area of the first piston is greater than a cross-sectional area of the second piston; and a transfer unit including an inlet, an outlet, and a third piston disposed in the transfer unit, wherein the inlet of the transfer unit is in fluid communication with the outlet of the first chamber, the outlet of the transfer unit is in fluid communication with an inlet of a second check valve, and an outlet of the second check valve is in fluid communication with the annular valve, and wherein the transfer unit includes a heavy fluid, which has a density greater than a drilling fluid, which is disposed in the well casing.

These and other features, aspects, and advantages of the disclosed embodiments will become better understood with reference to the following description and appended claims.

BRIEF DESCRIPTION OF THE DRAWINGS

The above and other aspects, advantages and features of this disclosure will become more apparent by describing in further detail exemplary embodiments thereof with reference to the accompanying drawings, in which.

Figure 1:
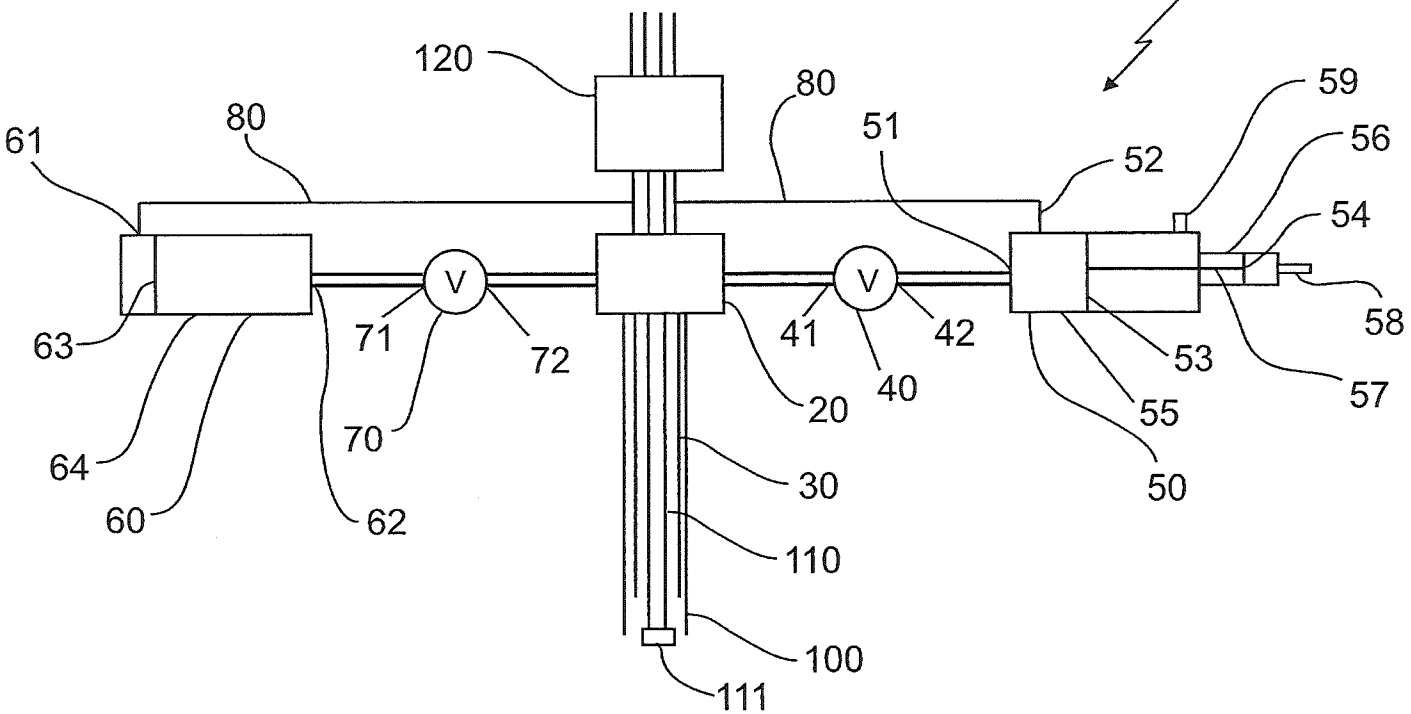
FIG. 1 is a representative embodiment of a pressure balanced drilling system.

The detailed description explains the exemplary embodiments, together with advantages and features, by way of example with reference to the drawings.

DETAILED DESCRIPTION OF THE INVENTION

Reference will now be made in detail to embodiments, examples of which are illustrated in the accompanying drawings, wherein, the thicknesses of layers and regions are exaggerated for clarity, like reference numerals refer to the like elements throughout, and detailed descriptions thereof will not be repeated.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third," etc. may be used herein to describe various elements, components, regions, layers, and/or sections, these elements, components, regions, layers and/or sections should not be limited by these terms. These terms are only used to distinguish one element, component, region, layer, or section from another element, component, region, layer, or section. Thus, a "first element," "component," "region," "layer," or "section" discussed below could be termed a "second element," "component," "region," "layer," or "section" without departing from the teachings of the present invention.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

As used herein, the term "fluid" may be a gas, a liquid, or a combination including at least one of the foregoing.

Figure 2:
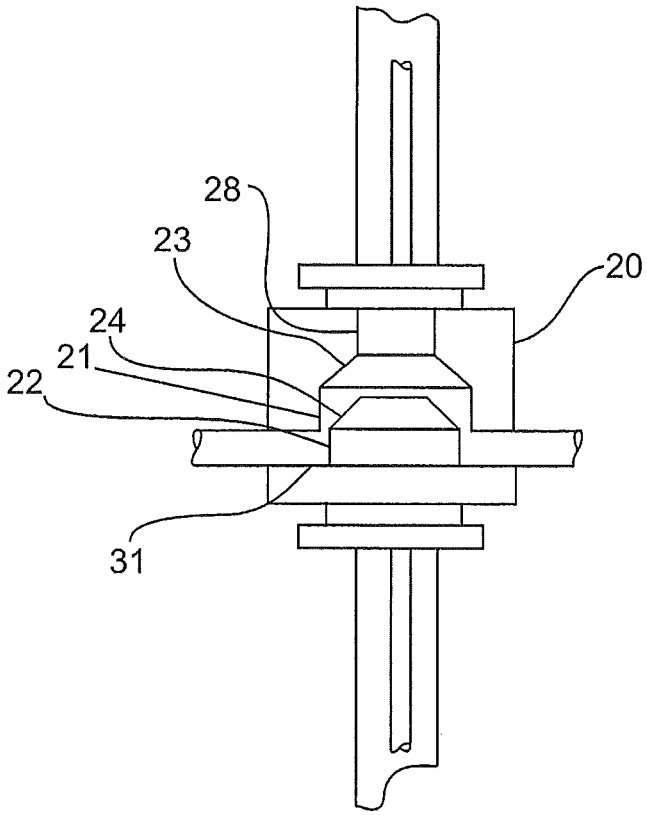
FIG. 2 is a representative embodiment of an annular valve in a disengaged configuration.

Disclosed is a well drilling system 10 as shown in FIG. 1. The well drilling system includes an annular valve 20 comprising a reaction chamber 21 as shown in FIG. 2, and a well casing 30, which is in fluid communication with the annular valve 20. The well drilling system 10 further comprises a first check valve 40, which is in fluid communication with the annular valve 20 via an inlet 41, and a hydraulic cylinder 50. The hydraulic cylinder 50 comprises an inlet 51 and an outlet 52, wherein the inlet 51 of the hydraulic cylinder 50 is in fluid communication with an outlet 42 of the first check valve. The well drilling system 10 further comprises a transfer unit 60, which comprises an inlet 61 and an outlet 62. The inlet 61 of the transfer unit 60 is in fluid communication with the outlet 52 of the hydraulic cylinder 50, the outlet 62 of the transfer unit 60 is in fluid communication with an inlet 71 of a second check valve 70, and an outlet 72 of the second check valve 70 is in fluid communication with the annular valve 20. In an embodiment, a transfer line 80 provides fluid communication between the outlet 52 of the hydraulic cylinder 50 and the inlet 61 of the transfer unit 60.

Figure 3:
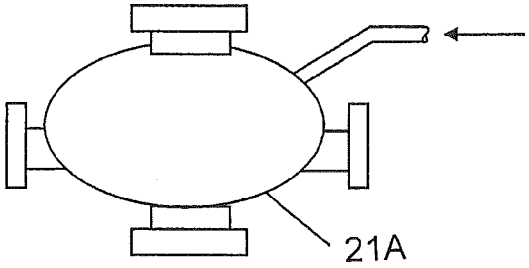
FIG. 3 is a representative embodiment of a reaction chamber having a substantially elliptical cross section.
Figure 4:
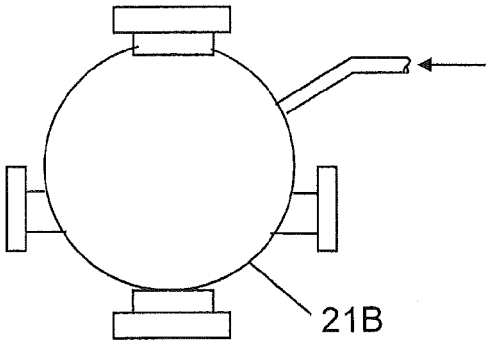
FIG. 4 is a representative embodiment of a reaction chamber having a substantially spherical cross section.
Figure 5:
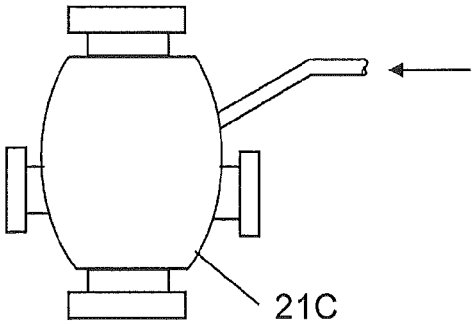
FIG. 5 is a representative embodiment of a reaction chamber having a substantially oblong cross section.
Figure 6:
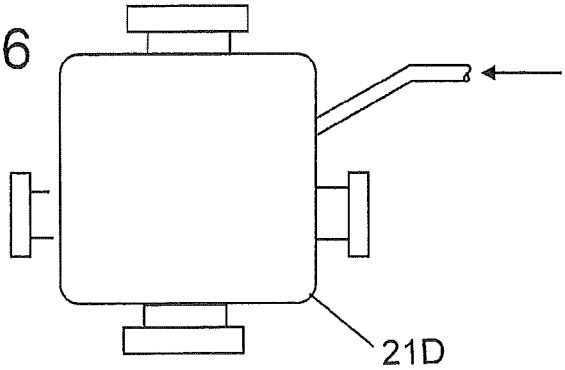
FIG. 6 is a representative embodiment of a reaction chamber having a substantially square cross section.

In an embodiment, the annular valve 20 may further comprise an annular packer 22 (e.g., packing unit) disposed in the reaction chamber 21 as shown in FIG. 2. The reaction chamber 21 may be substantially spherical in cross section, but is not limited thereto. In an embodiment, the reaction chamber 21 may have a substantially elliptical, spherical, oblong, or square lateral cross section, and may be a elliptical reaction chamber 21A as shown in FIG. 3, a spherical reaction chamber as shown in FIG. 4, an oblong reaction chamber as shown in FIG. 5, or a square reaction chamber as shown in FIG. 6, for example. The reaction chamber 21 may further comprise a seat 23, wherein a shape of a surface of the seat 23 substantially corresponds to a shape of a surface of the annular packer 22. The annular packer 22, when contacted by the seat 23, may substantially or entirely close the annular valve.

Figure 7:
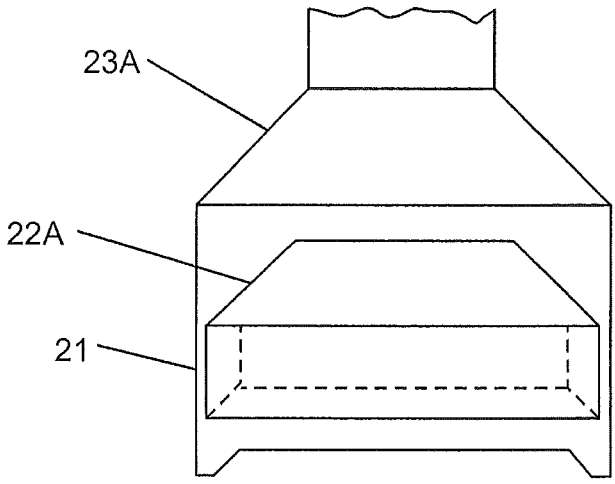
FIG. 7 is a representative embodiment of an annular valve having an angular annular packer.
Figure 8:
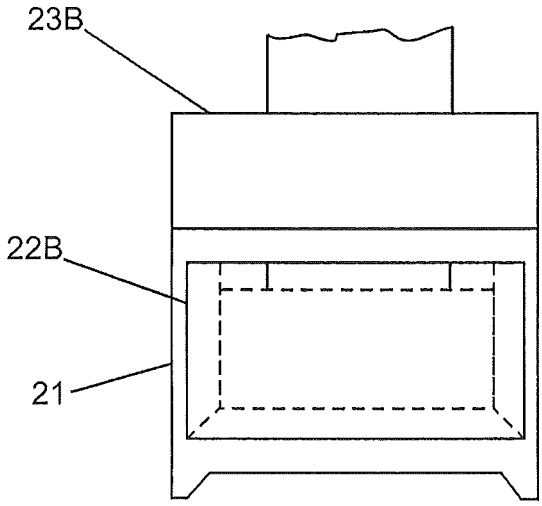
FIG. 8 is a representative embodiment of an annular valve having a square annular packer.
Figure 9:
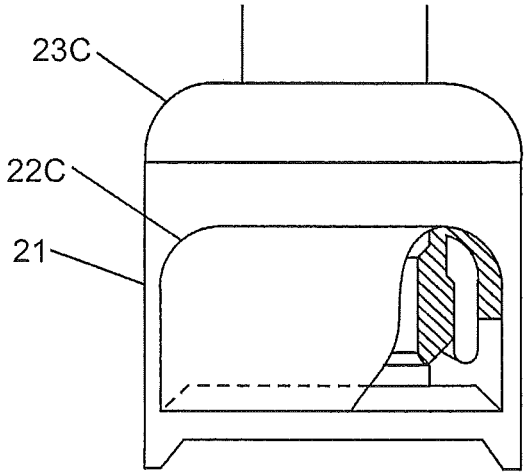
FIG. 9 is a representative embodiment of an annular valve having a dome annular packer.

The shape of the annular packer 22 and the shape of the seat 23 may have a substantially angular, square, dome shape, chamfer, or spherical shape, for example. In an embodiment, the annular packer may be an angular annular packer 22A, which has a shape corresponding to an angular seat 23A, as shown in FIG. 7. In another embodiment, the annular packer may be a square annular packer 22B, which has a shape corresponding to a square seat 23B, as shown in FIG. 8. In another embodiment, the annular packer may be a dome annular packer 22C, which has a shape corresponding to a dome seat 23C, as shown in FIG. 9.

Figure 10:
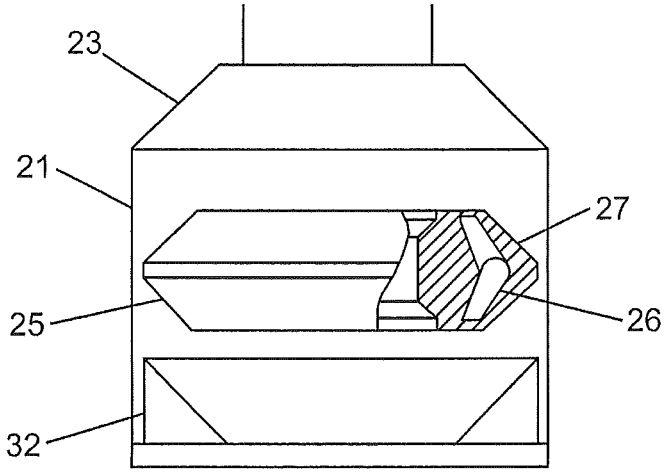
FIG. 10 is a representative embodiment of an annular valve having a double action packer.

Also, the annular packer 22 may be a double-action packer 25, as shown in FIG. 10. The double action packer 25 may comprise a segment 26 which acts upon a packing material 27 when the double-action packer 25 is contacted by, for example, the seat 23 and a floor 31 of the annular valve.

Figure 11:
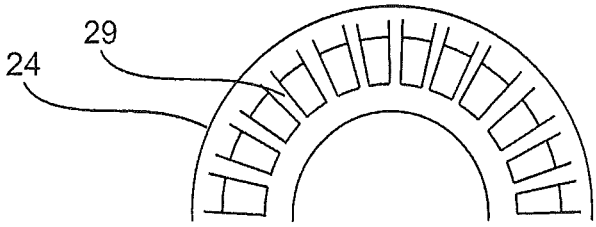
FIG. 11 is a representative embodiment of a bonnet.
Figure 12:
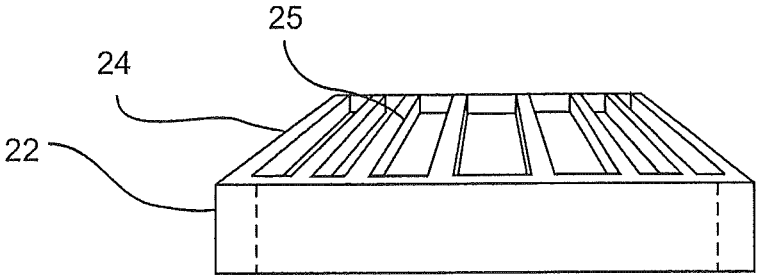
FIG. 12 is a representative embodiment of a bonnet.

The annular packer 22 may further comprise a bonnet 24, which comprises (e.g., defines) a port 29, as shown in FIGS. 11 and 12. The port 29 may provide fluid communication between a first side and an opposite second side of the annular packer 22. In an embodiment the first side may be a well casing side of the annular packer 22 (e.g., a lower portion of the reaction chamber 21), and the second side may be a seat side of the annular packer 22 (e.g., an upper portion of the reaction chamber 21). The port 29 may have a substantially rectilinear, square, trapezoidal, or spherical shape, but is not limited thereto.

Figure 13:
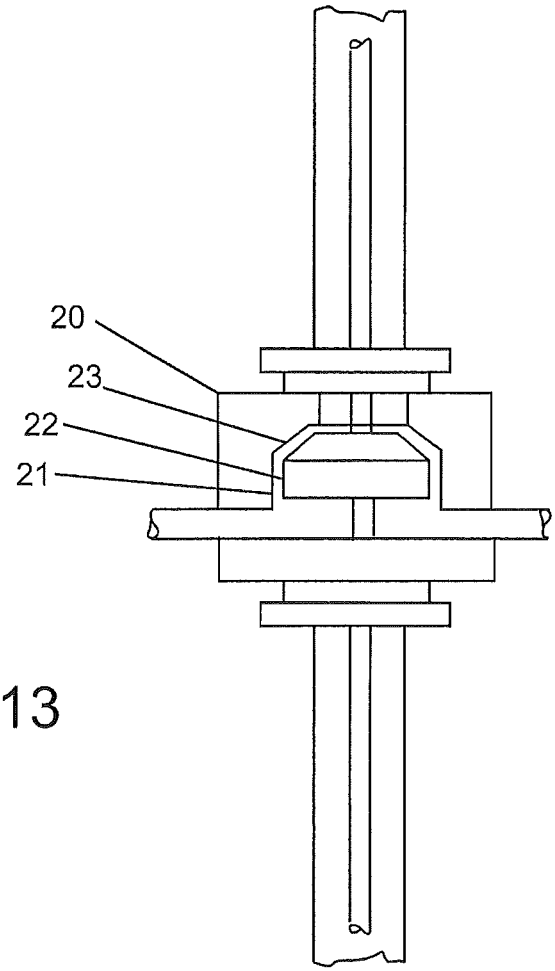
FIG. 13 is a representative embodiment of an annular valve in an engaged configuration.

The annular packer 22 may slidably engage the seat. Thus when in a disengaged configuration, the annular packer may rest on the floor 31 of the reaction chamber 21, as shown in FIG. 2. Alternatively, when in an engaged configuration, the annular packer 22 may be raised so that a surface of the annular packer approaches or partially, substantially, or entirely contacts the seat 23, as shown in FIG. 13. Thus the port 29 may be substantially or entirely obstructed when the annular packer 22 is slidably engaged, and thus approaches or contacts the seat 23.

The first check valve 40 and the second check valve 70 are in fluid communication with the reaction chamber 21 of the annular valve 20. In another embodiment, at least one of the first check valve 40 or the second check valve 70 may be directly connected to the reaction chamber 21. Alternatively, at least one of the first check valve 40 or the second check valve 70 may be directly connected to the well casing 30. In an embodiment, the first check valve 40 is configured to permit a fluid to flow from the annular valve 20 to the hydraulic cylinder 50, and to substantially or entirely preclude flow of the fluid from the hydraulic cylinder 50 to the annular valve 20. Also, the second check valve 70 may be configured to permit a fluid to flow from the transfer unit 60 to the annular valve 20, and to substantially or entirely preclude flow of the fluid from the annular valve 20 to the transfer unit 60.

The well drilling system may further comprise a sensor (not shown). The sensor may be disposed in the reaction chamber 21. The sensor may be configured to sense a position of the annular packer 22 within the reaction chamber 21. The sensor may be a piezoelectric sensor, a hall-effect sensor, or a proximity sensor, but is not limited thereto.

The well drilling system 10 may further comprise a drill string 110 having a drill bit 111. The drill string 110 may be disposed in the well casing 30, which is disposed within the well bore 100, and a portion of the drill string 110 may be disposed in a central portion 28 of the annular valve 20. Thus the drill string 110 may pass through the annular valve 20. The drill string 110 may comprise a drill bit 111 on a longitudinal end thereof.

The well bore 100, the well casing 30, an internal volume of the drill string, and the annular valve 20 may contain a first fluid, which may be a drilling fluid (e.g., drilling mud). The first fluid may comprise water, a clay such as bentontite clay, barium sulfate, calcium carbonate, hematite, xanthan gum, guar gum, glycol, carboxymethylcellulose, polyanionic cellulose ("PAC"), starch, a deflocculant, an acrylate, a polyphosphate, a lignosulfonate, tannic acid, or a combination including at least one of the foregoing. In addition, the first fluid may comprise a gas, such as natural gas.

The hydraulic cylinder 50 may further comprise a first piston 53, which is disposed within a first chamber 55 of the hydraulic cylinder 50. The first piston 53 may have a first side and an opposite second side, wherein the inlet 51 of the hydraulic cylinder 50 may be disposed adjacent to the first side of the first piston 53. Thus the first side of the first piston 53 may be in fluid communication with the well casing 30 via the first check valve 40, and the second side of the first piston 53 may be in fluid communication with the outlet 52. Also, the first chamber 55 may further comprise a second inlet 59, which may be in fluid communication with the second side of the first piston 53. In an embodiment wherein the second inlet 59 is open to seawater, a portion of the first chamber 55 which on the second side of the first piston 53 may contain seawater at a pressure corresponding to a depth of the well drilling system 10.

In an embodiment, the first chamber 55 may comprise a second fluid, such as water or other hydraulic fluid, for example. When the first fluid is directed into the inlet 51 of the hydraulic cylinder 50, the first piston 53 is displaced within the first chamber 55 and the second fluid in the first chamber 55 is directed to the outlet 52 of the first chamber 55.

The hydraulic cylinder may further comprise a second piston 54, which is disposed within a second chamber 56 of the hydraulic cylinder 50 and is coupled to the first piston by a coupler 57. Thus when the first piston 53 is displaced, the second piston 54 is also displaced. The second chamber 56 may comprise a hydraulic fluid. The hydraulic fluid may comprise water, mineral oil, rapeseed oil, canola oil, glycol, an ester, an organophosphate, a polyalphaolefin, propylene glycol, a silicone oil, or an alcohol, for example. Thus in an embodiment, the hydraulyic fluid in the second chamber 56 is different from the second fluid of the first chamber 55.

A cross sectional area (e.g. diameter) of the first piston 53 is greater than a cross-sectional area (e.g. diameter) of the second piston 54. The differential area provides a pressure amplification that is proportional to a ratio of the areas of the first and second pistons. Specifically, the pressure amplification may be determined according to Equation 1:

$$P_2=(A_1/A_2)P_1 \quad (1)$$

wherein $P_1$ is the pressure acting on the first piston, $P_2$ is the pressure acting on the second piston, $A_1$ is the area of the first piston, and $A_2$ is the area of the second piston. The ratio of the cross-sectional area of the first piston 53 to the cross-sectional area of the second piston 54 may be about 1:1 to about 1000:1, specifically 2:1 to about 800:1, more specifically 4:1 to about 600:1. Thus the hydraulic cylinder 50 may be a hydraulic amplifier.

An outlet 58 of the second chamber 56 may be in fluid communication with a device. The device may be a blowout preventer ("BOP") 120, such as a ram BOP or an annular BOP, or a generator, a valve, a sensor, or a combination including at least one of the foregoing. When the second piston 54 is actuated, for example in response to a kick, the hydraulic fluid in the second chamber 56 may be directed to the device, thereby energizing the device. Thus, in response to a kick, the second piston 54 may be actuated by the first piston 53, thereby directing the hydraulic fluid to a BOP, for example, automatically shutting the well.

The outlet 52 of the first chamber 55 may be fluidly connected to the inlet 61 of the transfer unit 60 by a transfer line 80. The transfer unit 60 further comprises a chamber 64, a third piston 63 disposed in the chamber 64, and an outlet 62. The chamber 64 of the transfer unit may comprise a heavy fluid. The heavy fluid may comprise water, a clay such as bentontite clay, barium sulfate, calcium carbonate, hematite, xanthan gum, guar gum, glycol, carboxymethylcellulose, polyanionic cellulose ("PAC"), starch, a deflocculant, an acrylate, a polyphosphate, a lignosulfonate, tannic acid, or a combination including at least one of the foregoing.

The heavy fluid has a density greater than or equal to a density of the first fluid, which is contained in the well bore 30. A ratio of the density of the heavy fluid to a density of the first fluid may be about 1:1 to about 20:1, specifically about 1.1:1 to about 15:1, more specifically about 1.5:1 to about 10:1. Also, a viscosity of the heavy fluid may be greater than a viscosity of the first fluid. A ratio of the viscosity of the heavy fluid to a viscosity of the first fluid may be about 1:1 to about 20:1, specifically about 1.1:1 to about 15:1, more specifically about 1.5:1 to about 10:1.

When the third piston 63, which is disposed within the chamber 64 of the transfer unit 60, is actuated, for example in response to a pressure kick, the heavy fluid is directed through the second check valve 70, into the reaction chamber 21, and into well casing 30, thereby effectively directing the pressure kick back down into the well. Also the annular packer 22 is directed towards the seat 23 by at least one of the drilling fluid and the heavy fluid, thereby engaging the annular valve 20. By directing the pressure kick back down into the well, and by engaging the annular valve, the pressure kick may be effectively controlled.

Figure 14:
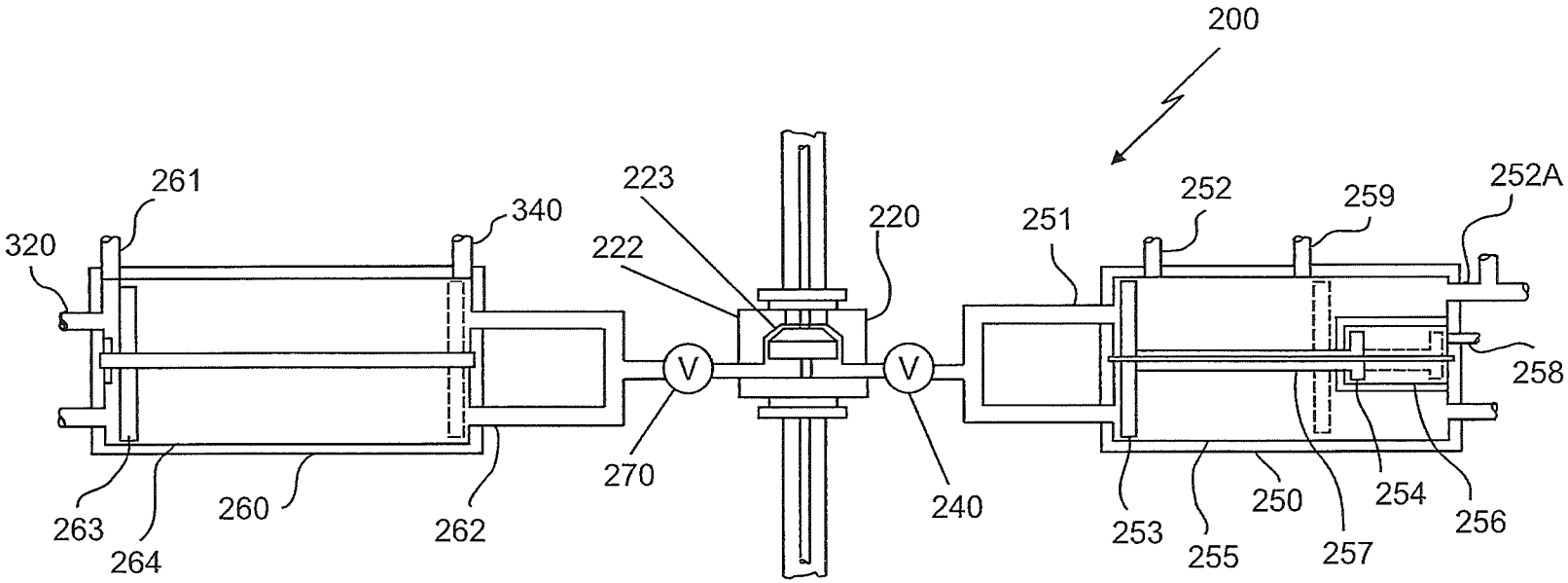
FIG. 14 is a representative alternative embodiment of a pressure balanced drilling system.

An embodiment of a well drilling system is shown in FIG. 14. In the following description, further description of similar elements included in the foregoing description may not repeated for clarity. The well drilling system 200 includes an annular valve 220, a hydraulic cylinder 250, and a transfer unit 260. The annular valve 220 includes an annular packer 222 which may be slidably engaged with a seat 223 of the annular valve 220. The hydraulic cylinder 250 of the well drilling system 200 may include an inlet 251, an outlet 252, and a first piston 253 disposed in a first chamber 255. The first piston 253 has a first side adjacent to the inlet 251 and an opposite second side. The first chamber 255 may further comprise a port 259, which may be in fluid communication with seawater. The outlet 252 may be disposed near the inlet 251, or the outlet 252 may be disposed on an end of the first chamber 255 which is opposite the inlet. In an embodiment, the first chamber may include both the outlet 252 disposed near the inlet 251 and an additional outlet 252A disposed on an end of the first chamber 255 which is opposite the inlet.

The hydraulic cylinder 250 may further comprise a second piston 254 disposed in a second chamber 256. In an embodiment, the second chamber 256 may be disposed within the first chamber 255, as shown in FIG. 14. The second piston 254 may be coupled to the first piston 253 by a coupler 257. Thus when the first piston 253 is actuated, the second piston 254 is also actuated. The second chamber 256 further comprises an outlet 258.

The well drilling system 200 may further comprise a transfer unit 260. The transfer unit may comprise an inlet 261, an outlet 262, and a third piston 263 disposed in a third chamber 264. The third piston 263 may include a first side adjacent to the inlet 261 and an opposite second side. Thus the inlet 261 may be in fluid communication with the first side of the third piston 263. Also, the transfer unit may further comprise a port 340. The port 340 may be in fluid communication with seawater.

The inlet 261 of the transfer unit 260 may be in fluid communication with the outlet 252 of the first chamber 255 by a transfer line (not shown). Thus a first fluid, which may comprise a drilling fluid, may be directed from the first chamber 255 to the transfer unit 260 through the transfer line. Also, the well drilling system includes a first check valve 240 between the annular valve 220 and the hydraulic cylinder 250, and a second check valve 270 between the transfer unit 260 and the annular valve 220.

Figure 15:
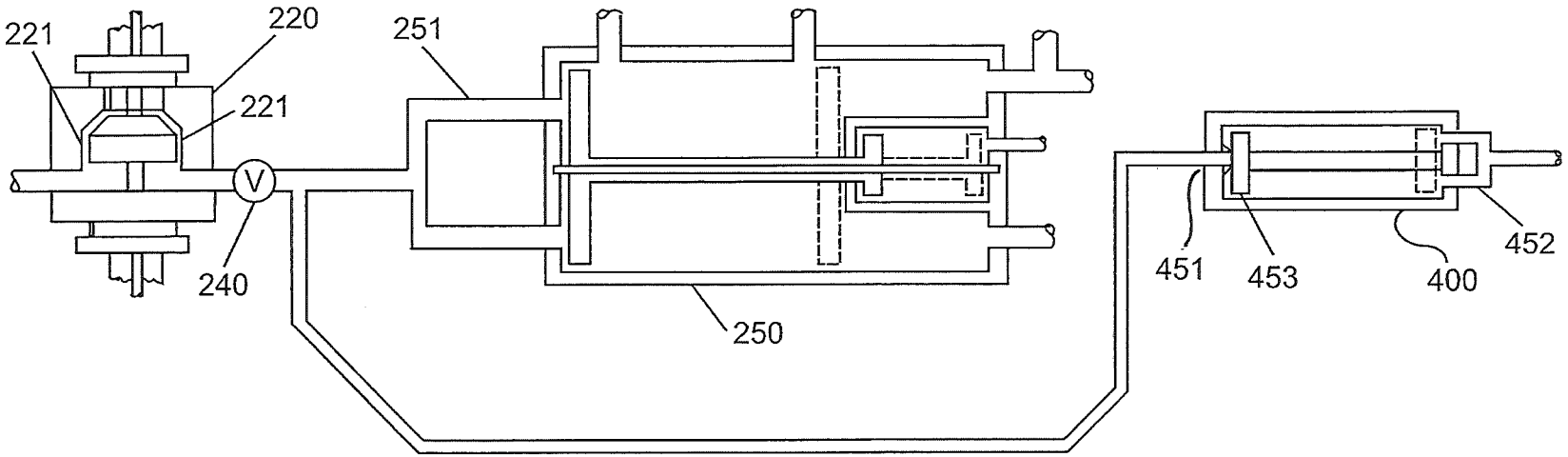
FIG. 15 is a representative alternative embodiment of a pressure balanced drilling system.

The well drilling system may further include an auxiliary cylinder 400, which is in fluid communication with the reaction chamber 221, as shown in FIG. 15. The auxiliary cylinder 400 may comprise a hydraulic fluid. An inlet 451 of the auxiliary cylinder 400 may be directly connected to the reaction chamber 221, or the inlet 451 of the auxiliary cylinder 400 may be connected between the reaction chamber 221 and the inlet 251 of the hydraulic cylinder 250 in a three-way (e.g., tee) configuration, as shown in FIG. 15. An outlet 452 of the auxiliary cylinder may be in fluid communication with a device. The device may be a blowout preventer ("BOP"), such as a ram BOP or an annular BOP, or a generator, a valve, a sensor, or a combination comprising at least one of the foregoing. When a piston 453 of the auxiliary cylinder 400 is actuated, for example in response to a pressure kick, the hydraulic fluid of the auxiliary cylinder 400 may be directed to the device, thereby energizing the device.

Figure 16:
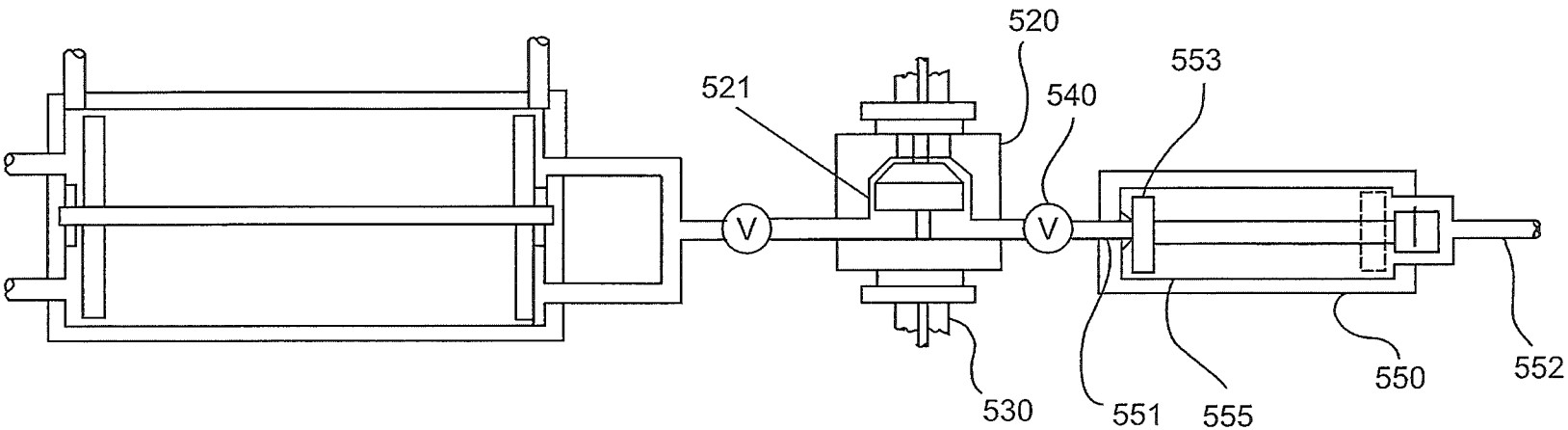
FIG. 16 is a representative alternative embodiment of a pressure balanced drilling system.

Referring to FIG. 16, in an embodiment, the well drilling system comprises an annular valve 520 comprising a reaction chamber 521, a well casing 530 in fluid communication with the annular valve 520, a first check valve 540 in fluid communication with the annular valve 520, and a hydraulic cylinder 550. The hydraulic cylinder 550 comprises an inlet 551 and an outlet 552. A piston 553 is disposed within a chamber 555 of the hydraulic cylinder 550. The inlet 551 is in fluid communication with the annular valve 520 via the first check valve 540. The outlet 552 may be in fluid communication with a device. The device may be a blowout preventer ("BOP"), such as a ram BOP or an annular BOP, or a generator, a valve, a sensor, or a combination comprising at least one of the foregoing. When the piston 553 of the hydraulic cylinder 550 is actuated, for example in response to a pressure kick, the hydraulic fluid of the hydraulic cylinder 550 may be directed to the device, thereby energizing the device.

A method of controlling a pressure kick, which may occur when drilling a well, will now be further disclosed. When a pressure kick occurs, a first fluid from at least one of the well bore 100 or the well casing 30 may be directed by the annular valve 20 through the first check valve 40 to the first chamber 55 of the hydraulic cylinder 50. The first fluid may comprise, consist essentially of, or consist of a drilling fluid. From the first chamber 55, a second fluid may be directed to the chamber 64 of the transfer unit 60 by, for example, the transfer line 80, which may be connected to an outlet 52 of the first chamber 55 and an inlet 61 of the transfer unit 60. The second fluid may actuate the piston 63 of the transfer unit 60. The piston 63 of the transfer unit 60 may then direct the third fluid through the second check valve 70 to the annular valve 20, and the third fluid may then be directed into the well bore 100 via the well casing 30. Thus, in response to a kick, the third piston of the transfer unit may direct the heavy fluid through the second check valve and into the well bore. The first fluid, directed by the pressure kick, and the third fluid may also act upon the annular packer 22, causing the annular packer to contact the seat 23, thereby automatically (e.g., passively) engaging the annular valve and substantially or entirely preventing the kick from propagating beyond the annular valve. Also, because the third fluid is directed into the well casing 30, the pressure kick is effectively directed back down into the well bore 100. Thus the pressure kick is effectively controlled and the pressure within the well bore maintained.

The first fluid, which may comprise the drilling fluid, and the second fluid may be the same or different. The second fluid may comprise the drilling fluid, a hydraulic fluid, or a combination including at least one of the foregoing. In an embodiment, the second fluid consists essentially of the drilling fluid and seawater. The third fluid may comprise, consist essentially of, or consist of heavy fluid, which has a density which is greater than the drilling fluid, and may have a viscosity which is greater than a viscosity of the drilling fluid.

The annular valve 20 comprises an annular packer 22. The annular packer 22 may be slidably engaged (e.g., directed towards the seat 23 of the annular valve 22) by at least one of the third fluid or the drilling fluid. Also, in an embodiment, the annular packer 22 may comprise a double-action packer 25. In an embodiment the double-action packer 25 may be compressed, for example between the seat 23 and a base 32 of the annular valve 20. When compressed, segments 26 of the double-action packer may act upon a packing material 27 to constrict an opening in the double-action packer, thereby partially or completely closing the annular valve 20.

In addition, the first piston 53 of the hydraulic cylinder may be coupled to a second piston 54 of the hydraulic cylinder. Also, area of the first piston 53 is less than an area of the second piston 54, thereby providing a hydraulic amplifier. Thus the hydraulic fluid directed by the second piston 54 has a pressure which is greater than a pressure of the first fluid, and may be used to actuate another device, such the blowout preventer 120 or a generator, for example. Thus in response to a kick, a device, such as the blowout preventer, may be automatically energized by the hydraulic fluid, which is directed by the second piston 54.

In an embodiment, the transfer line may connect the inlet 261 of the transfer unit 260 to at least one of the outlet 252, the additional outlet 252A, or the port 259 of the first chamber 255. Thus in an embodiment wherein the first piston 253 is actuated by the first fluid, the first piston directs a second fluid of the first chamber 255 to the transfer unit via at least one of the outlet 252, the additional outlet 252A, or the port 259. Because of the configuration of the outlet 252, the additional outlet 252A, or the port 259 on the first chamber 255, the first fluid, the second fluid, or a combination thereof may be directed to transfer unit 260 via the transfer line.

In an embodiment, the first fluid from the well bore 100 may also be directed via the annular valve 220 to an auxiliary cylinder 400, which may comprise a hydraulic fluid, for example. The first fluid may actuate the piston 453 of the auxiliary cylinder, thereby directing the hydraulic fluid in the auxiliary cylinder 400 to a device in fluid communication with an outlet 452 of the auxiliary cylinder, thereby energizing the device. Thus in response to a kick, a device, such as a generator, may be automatically energized by the auxiliary cylinder 400.

The first fluid, the second fluid, and the third fluid may be the same or different. Each of the first fluid, the second fluid, and the third fluid may be a hydraulic fluid, for example. In an embodiment, the third fluid has a density greater than the first fluid or the second fluid.

In an embodiment, the first piston 253 has a diameter of 24 inches, and a surface area of 452 square inches. Also, the second piston 254 has a diameter of 12 inches and a surface area of 113 square inches. In an embodiment, the port 259 is open to seawater, thus at a depth of 5000 feet, a seawater pressure of 2,225 pounds per square inch ("psi") is exerted against the second face of the first piston 253. In an embodiment wherein the well pressure is 1 psi greater than the seawater pressure, the first piston is actuated, and provides 452 pounds of force against the second piston, thereby providing 452 pounds of hydraulic force. In another embodiment, also using a 24 inch diameter first piston and a 12 inch diameter second piston, the well pressure is 10 psi greater than the seawater pressure, and the second piston provides 4,500 pounds of force. In another embodiment, also using a 24 inch diameter first piston and a 12 inch diameter second piston, the well pressure is 100 psi greater than the seawater pressure, and the second piston provides 45,000 pounds of force.

In an embodiment, a piston of the auxiliary cylinder has a diameter of 12 inches. The well pressure is 1 psi greater than the seawater pressure, and a force of 113 pounds is provided by the auxiliary cylinder. In another embodiment, well pressure is 100 psi greater than the seawater pressure, and a force of 11,300 pounds is provided by the auxiliary cylinder. In another embodiment, well pressure is 2,225 psi at a depth of 5,000 feet. A force of 251,425 pounds is provided.

While this disclosure describes exemplary embodiments, it will be understood by those skilled in the art that various changes can be made and equivalents can be substituted for elements thereof without departing from the scope of the disclosed embodiments. In addition, many modifications can be made to adapt a particular situation or material to the teachings of this disclosure without departing from the scope thereof. Therefore, it is intended that this disclosure not be limited to the particular embodiments disclosed as the best mode contemplated for carrying out this disclosure.

What is claimed is:

1. A well drilling system comprising:

an annular valve;

a well casing in fluid communication with the annular valve;

a first check valve in fluid communication with the annular valve;

a hydraulic cylinder including a first chamber having an inlet and an outlet, wherein the inlet of the first chamber is in fluid communication with an outlet of the first check valve; and a transfer unit including an inlet and an outlet, wherein the inlet of the transfer unit is in fluid communication with the outlet of the first chamber, the outlet of the transfer unit is in fluid communication with an inlet of a second check valve, and an outlet of the second check valve is in fluid communication with the annular valve.

2. The well drilling system of claim 1, wherein the annular valve further includes:

an annular packer disposed in a reaction chamber; and a seat, wherein a shape of a surface of the annular packer corresponds to a shape of a surface of the seat.

3. The well drilling system of claim 2, wherein the annular packer includes a bonnet which includes a plurality of ports, which provide fluid communication between a first side and an opposite second side of the annular packer.

4. The well drilling system of claim 2, wherein the annular packer slidably engages the seat.

5. The well drilling system of claim 3, wherein the bonnet has an angular, chamfer, square, spherical, or dome shape, or a combination including at least one of the foregoing.

6. The well drilling system of claim 2, wherein the annular packer includes a double action packer.

7. The well drilling system of claim 2, further comprising a sensor disposed in the reaction chamber, which senses a position of the annular packer.

8. The well drilling system of claim 2, wherein the first check valve and the second check valve are directly connected to the reaction chamber.

9. The well drilling system of claim 1, further comprising a drill string which is disposed in the well casing, wherein a portion of the drill string is disposed in the annular valve.

10. The well drilling system of claim 1, wherein the hydraulic cylinder further includes:

a first piston disposed in a first chamber of the hydraulic cylinder; and a second piston, which is disposed in a second chamber of the hydraulic cylinder and which is coupled to the first piston, wherein a cross-sectional area of the first piston is greater than a cross-sectional area of the second piston.

11. The well drilling system of claim 10, wherein the second chamber is disposed in the first chamber.

12. The well drilling system of claim 10, wherein a pressure in the second chamber is greater than a pressure in the first chamber.

13. The well drilling system of claim 11, wherein a ratio of the cross-sectional area of the first piston to a cross-sectional area of the second piston is about 1:1 to about 1000:1.

14. The well drilling system of claim 10, wherein the first piston further includes a first side and an opposite second side, wherein the first side of the first piston is in fluid communication with the inlet of the hydraulic cylinder and the well casing.

15. The well drilling system of claim 10, further comprising a second chamber, wherein the second piston is disposed in the second chamber and the second chamber further includes a hydraulic fluid.

16. The well drilling system of claim 15, wherein the second piston directs a hydraulic fluid to a blow-out-preventer, a generator, a valve, a sensor, or a combination including at least one of the foregoing.

17. The well drilling system of claim 1, further comprising an auxiliary cylinder including an inlet, wherein the inlet of the auxiliary cylinder is in fluid communication with the annular valve.

18. The well drilling system of claim 1, wherein the transfer unit comprises a heavy fluid, which has a density which is greater than or equal to a density of a drilling fluid, which is contained in the well bore.

19. A method of controlling a pressure kick, the method comprising:

directing a first fluid through a first check valve to a first chamber of a hydraulic cylinder;

directing a second fluid from the first chamber of the hydraulic cylinder to a chamber of a transfer unit;

actuating a piston of the transfer unit with the second fluid;

directing a third fluid with the piston of the transfer unit through a second check valve;

engaging an annular valve with at least one of the first fluid or the third fluid; and directing the third fluid into a well casing to control the pressure kick.

20. The method of claim 19, wherein the first fluid and the second fluid are different.

21. The method of claim 19, wherein the annular valve further comprises an annular packer, and the annular packer is slidably engaged by at least one of the first fluid or the third fluid.

22. The method of claim 20, further comprising:

actuating a first piston, which is disposed in the first chamber of the hydraulic cylinder, with the first fluid;

actuating a second piston, which is disposed in a second chamber of the hydraulic cylinder and is coupled to the first piston; and energizing a device with a fluid directed by the second piston.

23. The method of claim 22, wherein the device is a blow-out preventer, a generator, a valve, a sensor, or a combination including at least one of the foregoing.

24. The method of claim 23, wherein the second chamber is disposed in the first chamber.

25. The method of claim 19, further comprising disposing an auxiliary cylinder in fluid communication with the annular valve, and energizing a ram, a generator, a valve, a sensor, or a combination including at least one of the foregoing with a fluid directed by a piston of the auxiliary cylinder.

26. A well drilling system comprising:

an annular valve including a reaction chamber;

an annular packer disposed in the reaction chamber;

a well casing in fluid communication with the annular valve;

a first check valve in fluid communication with the annular valve;

a hydraulic cylinder including a first chamber having an inlet and an outlet, wherein the inlet of the first chamber is in fluid communication with an outlet of the first check valve, a first piston disposed in the first chamber, and a second piston, which is coupled to the first piston and is disposed in a second chamber of the hydraulic cylinder, and which directs a fluid which energizes a blow-out-preventer, a generator, a valve, a sensor, or a combination including at least one of the foregoing, wherein a cross-sectional area of the first piston is greater than a cross-sectional area of the second piston; and a transfer unit including an inlet, an outlet, and a third piston disposed in the transfer unit, wherein the inlet of the transfer unit is in fluid communication with the outlet of the first chamber, the outlet of the transfer unit is in fluid communication with an inlet of a second check valve, and an outlet of the second check valve is in fluid communication with the annular valve, and wherein the transfer unit includes a heavy fluid, which has a density greater than a drilling fluid, which is disposed in the well casing.

* * * * *